US009257096B2

(12) United States Patent
Masuyama

(10) Patent No.: US 9,257,096 B2
(45) Date of Patent: Feb. 9, 2016

(54) DISPLAY SYSTEM

(71) Applicant: BOE Technology Group Co., Ltd., Beijing (CN)

(72) Inventor: Katsuhiro Masuyama, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 20 days.

(21) Appl. No.: 14/497,881

(22) Filed: Sep. 26, 2014

(65) Prior Publication Data

US 2015/0379961 A1 Dec. 31, 2015

(30) Foreign Application Priority Data

Jun. 30, 2014 (CN) ..... 2014 1 0307081

(51) Int. Cl.

| | |
|---|---|
| ***G09G 5/10*** | (2006.01) |
| ***H05B 33/08*** | (2006.01) |
| ***G09G 3/36*** | (2006.01) |
| ***G09G 5/02*** | (2006.01) |

(52) U.S. Cl.

CPC .. *G09G 5/10* (2013.01); *G09G 3/36* (2013.01); *G09G 5/02* (2013.01); *H05B 33/0845* (2013.01)

(58) Field of Classification Search

CPC ..... G09G 2320/0626

See application file for complete search history.

(56) References Cited

U.S. PATENT DOCUMENTS

2005/0134527 A1 6/2005 Ouderkirk et al.
2013/0038212 A1 * 2/2013 Yabuta ..... G02F 1/133603 315/113

FOREIGN PATENT DOCUMENTS

| | | | |
|---|---|---|---|
| CN | 1607418 | A | 4/2005 |
| CN | 1825183 | A | 8/2006 |
| CN | 1932593 | A | 3/2007 |
| CN | 101493532 | A | 7/2009 |
| CN | 203190212 | U | 9/2013 |

OTHER PUBLICATIONS

Copy of first Chinese Office Action, including Search Report, for Chinese Patent Application No. 201410307081.X, dated Nov. 3, 2015, 11 pages.

* cited by examiner

*Primary Examiner* — Gerald Johnson
(74) *Attorney, Agent, or Firm* — Westman, Champlin & Koehler, P.A.

(57) ABSTRACT

The embodiments of the present invention disclose a display system comprising: a display panel; a backlight module for supplying backlight to the display panel; a drive module for driving the backlight module to emit light; and a control module for controlling the drive module to drive the backlight module to emit light, wherein the backlight module comprises first light emitting diodes and second light emitting diodes, and a spectral intensity of blue light of light emitted by the first light emitting diode is less than a spectral intensity of each of red light and green light of the light emitted by the first light emitting diode; wherein the drive module comprises a first drive unit for driving the first light emitting diodes to emit light under the control of the control module, and a second drive unit for driving the second light emitting diodes to emit light under the control of the control module.

13 Claims, 4 Drawing Sheets

DISPLAY SYSTEM

CROSS-REFERENCE TO RELATED APPLICATION

This application claims the benefit of Chinese Patent Application No. 201410307081.X filed on Jun. 30, 2014 in the State Intellectual Property Office of China, the whole disclosure of which is incorporated herein by reference.

BACKGROUND OF THE INVENTION

1. Field of the Invention

Embodiments of the present invention relate to the field of display, and particularly to a display system.

2. Description of the Related Art

There is a need to decrease a spectral intensity of blue light while a luminance and a chrominance of a picture displayed by a liquid crystal display are ensured.

SUMMARY OF THE INVENTION

The object of embodiments of the present invention is to provide a display system in order to solve a technical problem that a luminance and a chrominance of a display picture are adversely affected when a spectral intensity of blue light is decreased.

According to embodiments of the present invention, there is provided a display system comprising: a display panel; a backlight module for supplying backlight to the display panel; a drive module for driving the backlight module to emit light; and a control module for controlling the drive module to drive the backlight module to emit light, wherein the backlight module comprises first light emitting diodes and second light emitting diodes, and a spectral intensity of blue light of light emitted by the first light emitting diode is less than a spectral intensity of each of red light and green light of the light emitted by the first light emitting diode; wherein the drive module comprises a first drive unit for driving the first light emitting diodes to emit light under the control of the control module, and a second drive unit for driving the second light emitting diodes to emit light under the control of the control module.

DETAILED DESCRIPTION OF THE EMBODIMENTS

Figure 1:
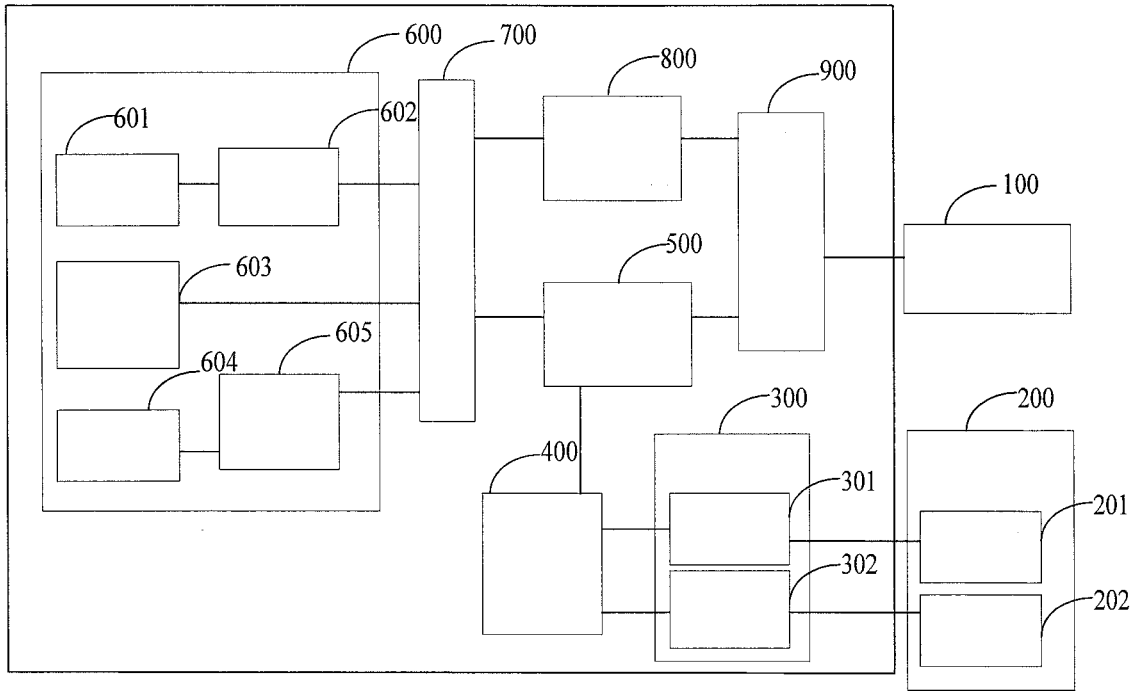
FIG. 1 is a schematic block diagram showing configuration of a display system according to an embodiment of the present invention.

A further description of the invention will be made in detail as below with reference to embodiments of the present invention taken in conjunction with the accompanying drawings. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

According to an general concept of the present invention, there is provided a display system comprising: a display panel; a backlight module for supplying backlight to the display panel; a drive module for driving the backlight module to emit light; and a control module for controlling the drive module to drive the backlight module to emit light, wherein the backlight module comprises first light emitting diodes and second light emitting diodes, and a spectral intensity of blue light of light emitted by the first light emitting diode is less than a spectral intensity of each of red light and green light of the light emitted by the first light emitting diode; wherein the drive module comprises a first drive unit for driving the first light emitting diodes to emit light under the control of the control module, and a second drive unit for driving the second light emitting diodes to emit light under the control of the control module.

In the display system according to embodiments of the present invention, the first light emitting diodes and the second light emitting diodes are disposed in the backlight module, and the spectral intensity of the blue light of the light emitted by the first light emitting diode is less than the spectral intensity of each of the red light and the green light of the light emitted by the first light emitting diode; accordingly the first drive unit for driving the first light emitting diodes to emit light and the second drive unit for driving the second light emitting diodes to emit light are disposed in the drive module; and the first drive unit and the second drive unit can drive the respective light emitting diodes in the backlight module to emit light under the control of the control module, respectively. In this way, the spectral intensity of the blue light can be decreased according to user's requirements while a luminance and a chrominance of a display picture are ensured.

A further description of the invention will be made in detail as below with reference to embodiments of the present invention taken in conjunction with the accompanying drawings. In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to embodiments of the present invention, there is provided a display system. As shown in FIG. 1, the display system comprises: a display panel 100; a backlight module 200 for supplying backlight to the display panel 100; a drive module 300 for driving the backlight module 200 to emit light; and a control module 400 for controlling the drive module 300 to drive the backlight module 200 to emit light.

The backlight module 200 comprises first light emitting diodes 201 and second light emitting diodes 202, and a spectral intensity of blue light of light emitted by the first light emitting diode 201 is less than a spectral intensity of each of red light and green light of the light emitted by the first light emitting diode 201.

The drive module 300 comprises a first drive unit 301 for driving the first light emitting diodes 201 to emit light under the control of the control module 400, and a second drive unit 302 for driving the second light emitting diodes 202 to emit light under the control of the control module 400.

In the display system according to embodiments of the present invention, the first light emitting diodes 201 and the second light emitting diodes 202 are disposed in the backlight module 200, and the spectral intensity of the blue light of the light emitted by the first light emitting diode 201 is less than the spectral intensity of each of the red light and the green light of the light emitted by the first light emitting diode 201. Accordingly, the first drive unit 301 for driving the first light emitting diodes 201 to emit light and the second drive unit 302 for driving the second light emitting diodes 202 to emit light are disposed in the drive module 300. The first drive unit 301 and the second drive unit 302 can drive the respective light emitting diodes in the backlight module 200 to emit light under the control of the control module, respectively. In this way, the spectral intensity of the blue light can be decreased according to user's requirements while a luminance and a chrominance of a display picture are ensured.

In an exemplary example, the first light emitting diode 201 is an ultraviolet ray-excited light emitting diode, while the second light emitting diode 202 is a blue light-excited light emitting diode. In another exemplary example, a spectral intensity of blue light of light emitted by the second light emitting diode 201 may be greater than a spectral intensity of each of red light and green light of light emitted by the second light emitting diode 201, or the second light emitting diode may be any other common light emitting diode. The first light emitting diode 201 and the second light emitting diode 202 are light emitting diodes emitting white light.

These modules of the display system will be described in detail as below.

Figure 2:
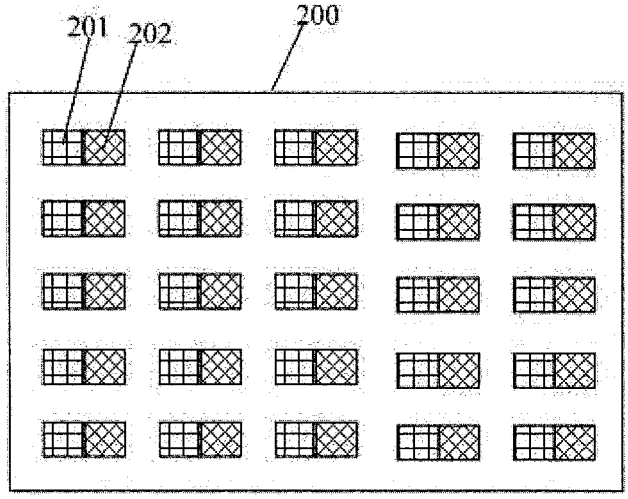
FIG. 2 is a schematic diagram showing a structure of a backlight source according to an embodiment of the present invention.

In some embodiments, as shown in FIG. 2, in the display system, the first light emitting diodes 201 and the second light emitting diodes 202 in the backlight module 200 may be disposed in a one-to-one correspondence.

Figure 3A:
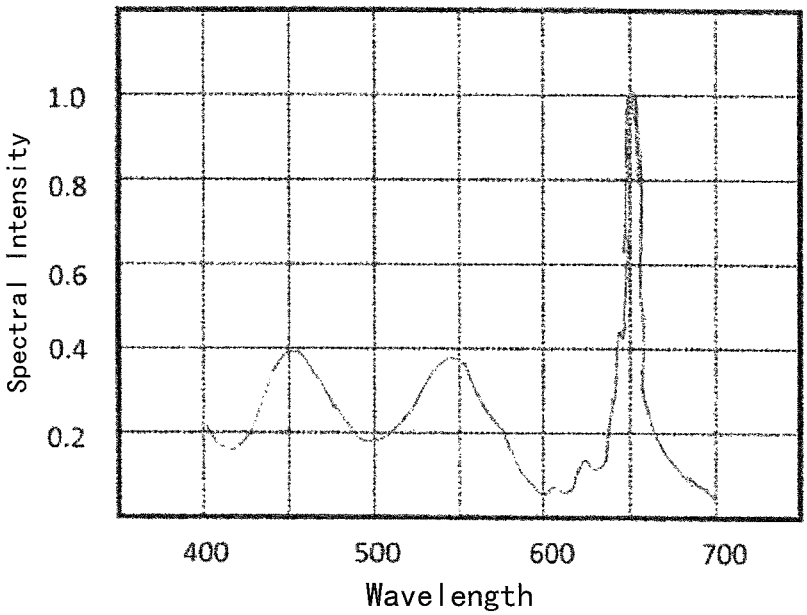
FIG. 3*a* is a schematic diagram of a spectrum of light from an ultraviolet ray-excited light emitting diode according to an embodiment of the present invention.
Figure 3B:
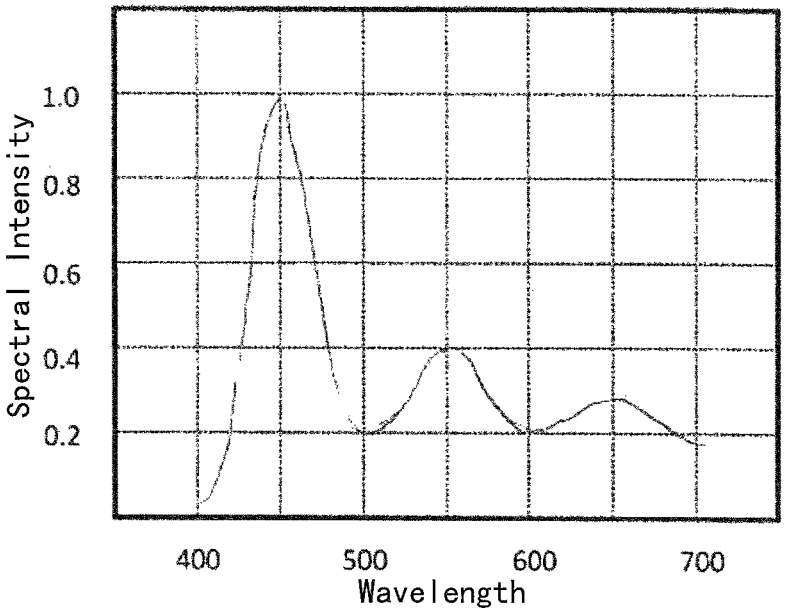
FIG. 3*b* is a schematic diagram of a spectrum of light from a blue light-excited light emitting diode according to an embodiment of the present invention.

If the first light emitting diode 201 is an ultraviolet ray-excited light emitting diode while the second light emitting diode 202 is a blue light-excited light emitting diode, a spectrum of light from the backlight module when the ultraviolet ray-excited, first light emitting diodes 201 alone emit light is shown in FIG. 3*a*, while a spectrum of light from the backlight module when the blue light-excited, second light emitting diodes 202 alone emit light is shown in FIG. 3*b*. It can be seen by comparing FIGS. 3*a* and 3*b* that peak values of spectral intensity of light from the backlight module when the first light emitting diodes 201 alone emit light are different from peak values of spectral intensity of light from the backlight module when the second light emitting diodes 202 alone emit light.

In some embodiments, the display system can operate in two display modes, i.e., a wide-gamut mode and a blue-light spectral intensity reduction mode, and switching of the corresponding modes is controlled by the control module 400. In the wide-color gamut mode, the control module 400 controls the first drive unit 301 to drive the first light emitting diodes 201 to emit light while controlling the second drive unit 302 to drive the second light emitting diodes 202 to emit light.

Figure 3C:
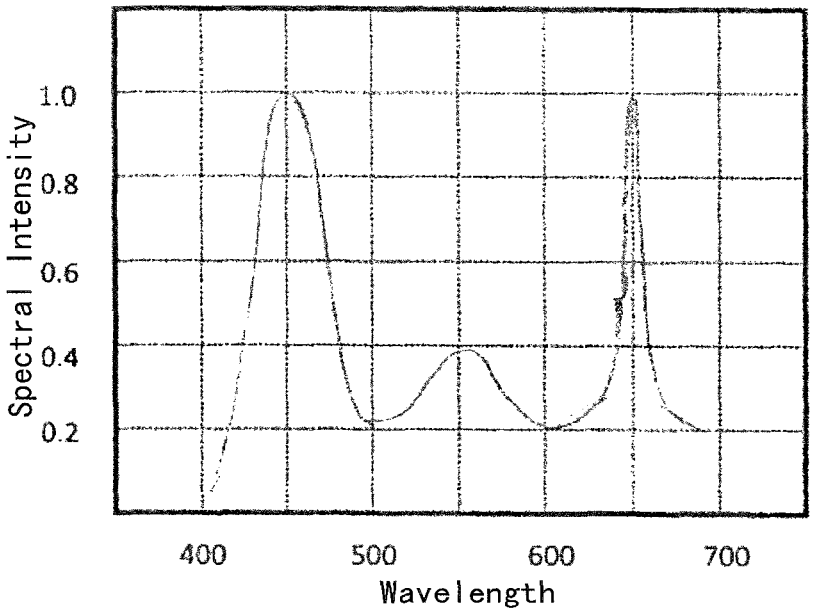
FIG. 3*c* is a schematic diagram of a spectrum of light from the backlight source in a wide-gamut mode according to an embodiment of the present invention.

If the first light emitting diode 201 is an ultraviolet ray-excited light emitting diode while the second light emitting diode 202 is a blue light-excited light emitting diode, a spectrum of light from the backlight module in the wide-color gamut mode is shown in FIG. 3*c*.

In the blue-light spectral intensity reduction mode, the control module 400 controls only the first drive unit 301 to drive the first light emitting diodes 201 to emit light. In this case, the second drive unit 302 is in an inactive state.

If the first light emitting diode 201 is an ultraviolet ray-excited light emitting diode while the second light emitting diode 202 is a blue light-excited light emitting diode, a spectrum of light from the backlight module in the blue-light spectral intensity reduction mode is shown in FIG. 3*b*.

In this way, a user can select different display modes according to his/her requirements, thereby decreasing a spectral intensity of blue light according to user's requirements while a luminance and a chrominance of a display picture are ensured.

In some embodiments, in order to ensure reproducibility of color of a display picture, the display system needs to adjust a gain of a blue signal both in the wide-color gamut display mode and the blue-light spectral intensity reduction display mode. Therefore, as shown in FIG. 1, the display system may further comprise a chrominance adjustment module 500. The entire picture will have a reduced color temperature and become overred due to the light of which the spectral intensity of the blue light is reduced in the blue-light spectral intensity reduction mode. Therefore, the chrominance adjustment module 500 may be specifically configured to increase a gain of a blue signal of a display image signal under the control of the control module 400 in the blue-light spectral intensity reduction mode. In this way, a blue-light brightness is increased to ensure normal display of color of the picture. Accordingly, the blue light-excited light emitting diodes and the ultraviolet ray-excited light emitting diodes simultaneously emit light in the wide-color gamut display mode. Therefore, the chrominance adjustment module 500 is also configured to decrease the gain of the blue signal of the display image signal under the control of the control module 400 in the wide-color gamut mode. In this way, the spectral intensity of the blue light is decreased while the luminance and the chrominance of the display picture are ensured. As a result, normal display of the color of the picture can be ensured.

Figure 4:
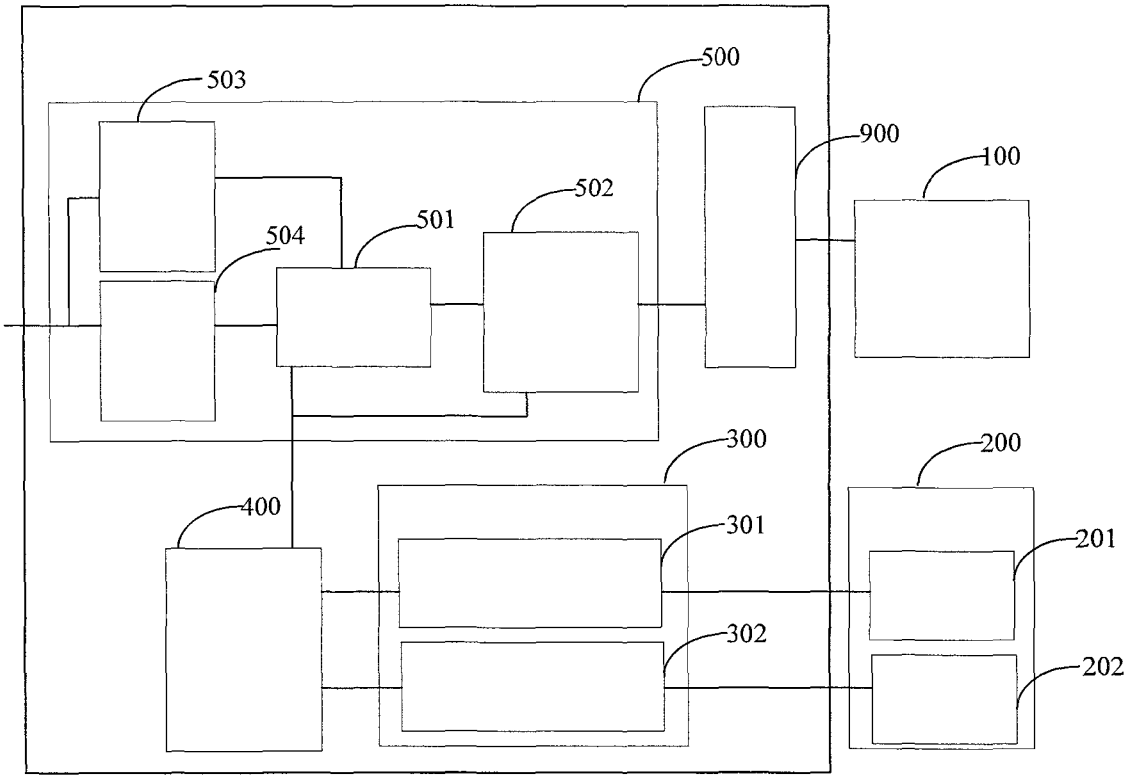
FIG. 4 is a schematic block diagram showing specific configuration of a chrominance adjustment module of a display system according to an embodiment of the present invention.

In some embodiments, as shown in FIG. 4, the chrominance adjustment module 500 of the display system may specifically comprise:

a hue gain adjustment circuit 501 for performing an adjustment of increasing a gain of a blue signal of a received display image signal under the control of the control module 400 in the blue-light spectral intensity reduction mode; and for performing an adjustment of decreasing the gain of the blue signal of the received display image signal under the control of the control module 400 in the wide-gamut display mode, thereby ensuring normal display of color of a display picture; and a drive switching adjustment circuit 502 for performing a mode switching between the blue-light spectral intensity reduction mode and the wide-gamut display mode under the control of the control module 400 according to user's requirement, and outputting a display image signal processed by the hue gain adjustment circuit 501.

Furthermore, as shown in FIG. 4, the chrominance adjustment module 500 of the display system may further comprise:

a histogram characteristic detection circuit 503 for performing a histogram characteristic analysis of the received display image signal to acquire a parameter value of a gray scale and a parameter value of a brightness of the display image signal, and outputting the parameter values to the hue gain adjustment circuit 501; and a chrominance histogram transformation circuit 504 for performing a matrix transformation of a received display image signal according to a pixel arrangement of the display panel to obtain a display image signal corresponding to the pixel arrangement, and outputting the display image signal corresponding to the pixel arrangement to the hue gain adjustment circuit 501.

Specifically, when the chrominance adjustment module 500 of the display system according to the embodiments of the present invention operates, the histogram characteristic detection circuit 503 performs the histogram characteristic analysis of a received display image signal to acquire the parameter value of the gray scale and the parameter value of the brightness of the display image signal, and outputs these parameter values to the hue gain adjustment circuit 501; while the chrominance histogram transformation circuit 504 performs the matrix transformation of the received display image signal according to a pixel arrangement of the display panel to obtain the display image signal corresponding to the pixel arrangement, and outputs the display image signal corresponding to the pixel arrangement to the hue gain adjustment circuit 501. The hue gain adjustment circuit 501 adjusts a gain of a blue signal of a received display image signal under the control of the control module 400 and sends the adjusted image signal to the drive switching adjustment circuit 502. The drive switching adjustment circuit 502 performs the mode switching between the blue-light spectral intensity reduction mode and the wide-color gamut display mode under the control of the control module 400 according to user's requirement, and outputs the display image signal processed by the hue gain adjustment circuit 501. In this way, the blue signal is adjusted both in the wide-color gamut display mode and the blue-light spectral intensity reduction display mode, thereby ensuring reproducibility of color of a display picture and reducing the blue-light spectral intensity.

In some embodiments, as shown in FIG. 1, the display system may further comprise: a signal receiving module 600, a format conversion module 700, a luminance adjustment module 800, and a signal output module 900.

The signal receiving module 600 is configured to receive display image signals sent by various external signal sources. Generally, the signal receiving module 600 comprises submodules such as a tuner 601, a motion image decoder 602, a high-definition multimedia interface 603, an analogue signal input 604, and an analog-to-digital three-dimensional conversion device 605, etc., for specifically performing primary processings, such as tuning, decoding, and analog-to-digital conversion, etc., of the received display image signals, and transmits the processed display image signals to the format conversion module 700.

The format conversion module 700 is configured to convert the received display image signals sent by the various external signal sources into display image signals with a uniform format and send the display image signals with the uniform format to the luminance adjustment module 800 and the chrominance adjustment module 500.

The luminance adjustment module 800 is configured to adjust a luminance of the display image signal sent by the format conversion module 700.

The signal output module 900 is configured to output the display image signal processed by the luminance adjustment module 800 and the chrominance adjustment module 500.

Specifically, when the display system according to the embodiments of the present invention operates, the signal receiving module 600 receives a display image signal sent by an external signal source and performs primary processings, such as tuning, decoding, and analog-to-digital conversion, etc., of the received display image signal; and the format conversion module 700 converts the display image signal primarily processed by the signal receiving module 600 into a display image signal with the uniform format and transmits the display image signal with the uniform format to the chrominance adjustment module 500 and the luminance adjustment module 800. The chrominance adjustment module 500 processes the received display image signal under the control of the control module 400, and the display image signal processed by the chrominance adjustment module 500 and the luminance adjustment module 800 is outputted to the display panel 100 through the signal output module 900. Meanwhile, the drive module 300 drives the backlight module 200 to emit light under the control of the control module 400. As a result, it is ensured that the display panel 100 normally displays a picture.

In some embodiments, as shown in FIG. 1, in the display system, the signal receiving module 600, the format conversion module 700, the luminance adjustment module 800, the chrominance adjustment module 500, the signal output module 900, the control module 400, and the drive module 300 may be disposed on a same circuit board. This design facilitates compact design of the circuit board and saves a wiring.

Furthermore, in the display system according to the embodiments of the present invention, the ultraviolet ray-excited first light emitting diodes 201 and the blue light-excited second light emitting diodes 202 in a one-to-one correspondence are disposed in the backlight module 200, and accordingly the first drive unit 301 for driving the first light emitting diodes 201 to emit light and the second drive unit 302 for driving the second light emitting diodes 202 to emit light are disposed in the drive module 300. In this way, the spectral intensity of the blue light can be decreased in the wide- color gamut mode under the control of the control module 400. In other words, the spectral intensity of the blue light is reduced while reproducibility of color of a display picture is ensured.

Figure 5:
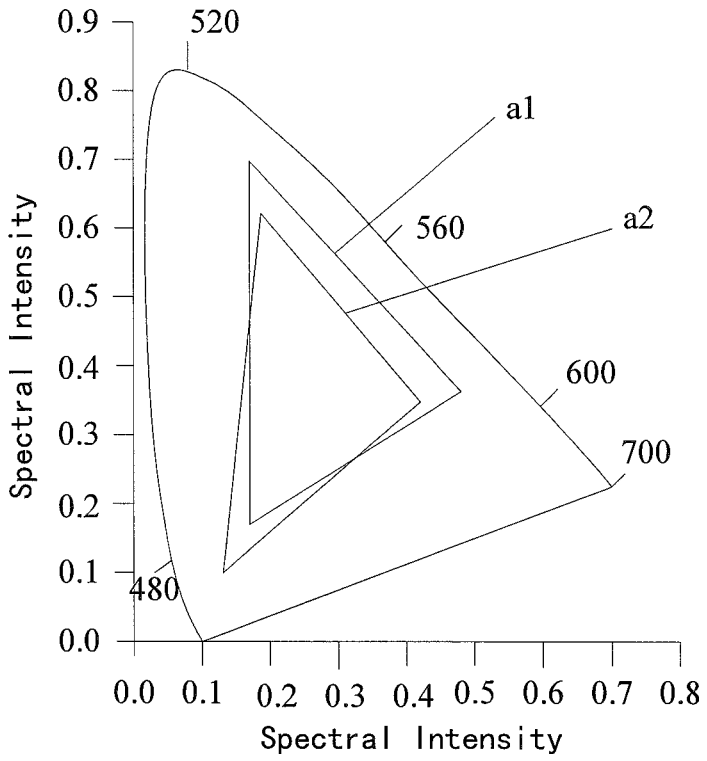
FIG. 5 is a schematic diagram showing a color space or a color reproduction range of the display system according to an embodiment of the present invention.

FIG. 5 shows a color reproduction range of the display system according to the embodiment of the present invention in the wide- color gamut mode. As shown in FIG. 5, a total color reproduction range is represented by a sum of a color reproduction range a1 (of a triangular area) and a color reproduction range a2 (of a triangular area).

In an exemplary example, if the first light emitting diode 201 is an ultraviolet ray-excited light emitting diode while the second light emitting diode 202 is a blue light-excited light emitting diode, the ultraviolet ray-excited light emitting diodes and the blue light-excited light emitting diodes are simultaneously driven, and a spectrum of the ultraviolet ray-excited light emitting diode is gentle and close to a spectrum of the blue light-excited light emitting diode. In this way, the spectral intensity of the blue light can be reduced. In the wide-color gamut mode, the reproducibility of color is ensured while the blue-light spectral intensity is decreased.

In the display system according to the embodiments of the present invention, the first light emitting diodes and the second light emitting diodes are disposed in the backlight module, and the spectral intensity of the blue light of the light emitted by the first light emitting diode is less than the spectral intensity of each of the red light and the green light of the light emitted by the first light emitting diode; accordingly the first drive unit for driving the first light emitting diodes to emit light and the second drive unit for driving the second light emitting diodes to emit light are disposed in the drive module; and the first drive unit and the second drive unit can drive the respective light emitting diodes in the backlight module to emit light under the control of the control module, respectively. In this way, the spectral intensity of the blue light can be decreased according to user's requirements while a luminance and a chrominance of a display picture are ensured.

While the blocks and/or elements are illustrated in the drawings, the drawings are provided only for description of the embodiments of the present invention and an actual connectional and/or positional relationship among components of the display system according to the embodiments is not limited to those illustrated in the drawings.

The above embodiments are only used to explain the present invention, and should not be construed to limit the present invention. It will be understood by those skilled in the art that various changes and modifications may be made therein without departing from the spirit of the present invention, the scope of which is defined in the appended claims and their equivalents.

REFERENCE LISTING

In FIG. 1:
600 Signal receiving module
601 Tuner
602 Motion image decoder
603 High-definition multimedia interface
604 Analogue signal input
605 Analog-to-digital three-dimensional conversion device
700 Format conversion module
800 Luminance adjustment module
900 Signal output module
500 Chrominance adjustment module
400 Control module
300 Drive module
301 First drive unit
302 Second drive unit
100 Display panel
200 Backlight module
201 First light emitting diodes
202 Second light emitting diodes
In FIG. 4:
500 Chrominance adjustment module
503 Histogram characteristic detection circuit
504 Chrominance histogram transformation circuit
501 Hue gain adjustment circuit
502 Drive switching adjustment circuit
900 Signal output module
400 Control module
300 Drive module
301 First drive unit
302 Second drive unit
100 Display panel
200 Backlight module
201 First light emitting diodes
202 Second light emitting diodes

The invention claimed is:

1. A display system, comprising:
a display panel;
a backlight module for supplying backlight to the display panel;
a drive module for driving the backlight module to emit light; and
a control module for controlling the drive module to drive the backlight module to emit light,
wherein the backlight module comprises first light emitting diodes and second light emitting diodes, and a spectral intensity of blue light of light emitted by the first light emitting diodes is lower than a spectral intensity of each of red light and green light of the light emitted by the first light emitting diodes; and
wherein the drive module comprises:
a first drive unit for driving the first light emitting diodes to emit light under the control of the control module, and
a second drive unit for driving the second light emitting diodes to emit light under the control of the control module.

2. The display system of claim 1, wherein:
the first light emitting diodes are of an ultraviolet ray-excited light emitting diode, and the second light emitting diodes are of a blue light-excited light emitting diode.

3. The display system of claim 1, wherein:
a spectral intensity of blue light of light emitted by the second light emitting diodes is higher than a spectral intensity of each of red light and green light of the light emitted by the second light emitting diodes.

4. The display system of claim 2, wherein:
a spectral intensity of blue light of light emitted by the second light emitting diodes is higher than a spectral intensity of each of red light and green light of the light emitted by the second light emitting diodes.

5. The display system of claim 1, wherein the control module is configured to in a wide-color gamut display mode, control the first drive unit to drive the first light emitting diodes to emit light while controlling the second drive unit to drive the second light emitting diodes to emit light; and
only control the first drive unit to drive the first light emitting diodes to emit light in a blue-light spectral intensity reduction mode.

6. The display system of claim 5, further comprising:
a chrominance adjustment module for increasing a gain of a blue signal of a display image signal under the control of the control module in the blue-light spectral intensity reduction mode, and for decreasing the gain of the blue signal of the display image signal under the control of the control module in the wide-color gamut mode.

7. The display system of claim 6, wherein:
the chrominance adjustment module comprises:
a hue gain adjustment circuit for performing an adjustment of increasing a gain of a blue signal of a received display image signal under the control of the control module in the blue-light spectral intensity reduction mode, and for performing an adjustment of decreasing the gain of the blue signal of the received display image signal under the control of the control module in the wide-color gamut display mode; and
a drive switching adjustment circuit for performing a mode switching between the blue-light spectral intensity reduction mode and the wide-color gamut display mode under the control of the control module, and outputting a display image signal processed by the hue gain adjustment circuit.

8. The display system of claim 7, wherein:
the chrominance adjustment module further comprises:
a histogram characteristic detection circuit for performing a histogram characteristic analysis of the received display image signal to acquire a parameter value of a gray scale and a parameter value of a brightness of the display image signal, and outputting the parameter values to the hue gain adjustment circuit; and
a chrominance histogram transformation circuit for performing a matrix transformation of the received display image signal according to a pixel arrangement of the display panel to obtain a display image signal corresponding to the pixel arrangement, and outputting the display image signal corresponding to the pixel arrangement to the hue gain adjustment circuit.

9. The display system of claim 6, further comprising a signal receiving module, a format conversion module, a luminance adjustment module, and a signal output module, wherein:

the signal receiving module is configured to receive display image signals sent by various external signal sources;

the format conversion module is configured to convert the received display image signals sent by the various external signal sources into display image signals with a uniform format and send the display image signals with the uniform format to the luminance adjustment module and the chrominance adjustment module;

the luminance adjustment module is configured to adjust luminance of the display image signals sent by the format conversion module; and the signal output module is configured to output the display image signals processed by the luminance adjustment module and the chrominance adjustment module.

10. The display system of claim 7, further comprising a signal receiving module, a format conversion module, a luminance adjustment module, and a signal output module, wherein:

the signal receiving module is configured to receive display image signals sent by various external signal sources;

the format conversion module is configured to convert the received display image signals sent by the various external signal sources into display image signals with a uniform format and send the display image signals with the uniform format to the luminance adjustment module and the chrominance adjustment module;

the luminance adjustment module is configured to adjust luminance of the display image signals sent by the format conversion module; and the signal output module is configured to output the display image signals processed by the luminance adjustment module and the chrominance adjustment module.

11. The display system of claim 9, wherein:

the signal receiving module, the format conversion module, the luminance adjustment module, the chrominance adjustment module, the signal output module, the control module, and the drive module are disposed on the same circuit board.

12. The display system of claim 10, wherein:

the signal receiving module, the format conversion module, the luminance adjustment module, the chrominance adjustment module, the signal output module, the control module, and the drive module are disposed on the same circuit board.

13. The display system of claim 1, wherein:

there is an one-to-one correspondence between the first light emitting diodes and the second light emitting diodes in the backlight module.

* * * * *